US006287169B1

(12) United States Patent
Willms et al.

(10) Patent No.: US 6,287,169 B1
(45) Date of Patent: Sep. 11, 2001

(54) GARMENT FOR USE WITH AN ABSORBENT ARTICLE

(75) Inventors: Eric Joachim Willms, Altdorf; Achim Schmitt, Münster-Sarmsheim, both of (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,542

(22) PCT Filed: Nov. 13, 1997

(86) PCT No.: PCT/US97/20576

§ 371 Date: Jul. 10, 2000

§ 102(e) Date: Jul. 10, 2000

(87) PCT Pub. No.: WO99/25299

PCT Pub. Date: May 27, 1999

(51) Int. Cl.[7] ..... A41D 1/00
(52) U.S. Cl. ..... 450/101; 450/100; 2/400
(58) Field of Search ..... 2/400–408; 450/99–105; 604/385.1, 385.2, 386, 387, 393, 394, 395, 396

(56) References Cited

U.S. PATENT DOCUMENTS 2,052,598 9/1936 Berg .
2,641,257 6/1953 Rutledge .
4,355,425 * 10/1982 Jones et al. ..... 2/402
5,611,722 3/1997 Osborne .
5,940,887 * 8/1999 Rajal ..... 2/400 X

FOREIGN PATENT DOCUMENTS 0 073 183 A1 3/1983 (EP) .
2 282 522 A 4/1995 (GB) .

* cited by examiner

*Primary Examiner*—Gloria M. Hale
(74) *Attorney, Agent, or Firm*—Ingrid N. Hickman; Matthew P. Fitzpatrick; Kevin C. Johnson

(57) ABSTRACT

The present invention relates to garments that have close body fit. The garment of the present invention comprises an elasticized waistband, a front panel having first and second sections, a rear panel having first and second sections, a crotch region disposed between and joining the front panel to the rear panel and a pair of elasticized leg openings. The first section of the front panel has a greater resistance to streching in the lateral direction than the second section of the front panel. The first section of the rear panel has a greater resistance to stretching in the lateral direction than the second section of the rear panel. The crotch region is provided with a longitudinal stretch control member that is disposed along the longitudinal centerline of the undergarment. The longitudinal stretch control member limits the stretch of the crotch region in the longitudinal direction causing the crotch region to conform to a weare's skin surface. A front stretch control member is disposed in the front panel and extends from the longitudinal stretch control member to the waistband. A rear stretch control member is disposed in the rear panel and extends from the longitudinal stretch control member to the waistband.

23 Claims, 7 Drawing Sheets

GARMENT FOR USE WITH AN ABSORBENT ARTICLE

FIELD OF THE INVENTION

The present invention relates to garments, particularly to garments that can be used in conjunction with an absorbent article, and more particularly to garments a user can wear with an incontinence device.

BACKGROUND OF THE INVENTION

As is known, disposable incontinence devices are commercially available in a wide variety of configurations for the specific purpose of absorbing and retaining urine and other body discharges. Typically, these garments have a portion that is designed to hold or position a disposable absorbent article against the body of the wearer. A number of these garments also have structural features that hold the absorbent article in a desired position until the disposable absorbent article is soiled and discarded.

Prior art developments includes GB 2 282 053, which describes a panty that may be used by men who need to wear an absorbent product in the region of their groin as a result of a medical condition. The panty is so configured and constructed that, in use, the absorbent product firmly embraces the body of the wearer by the panty via a partial lining of impermeable material, and movement of t the absorbent product is prevented. This solution has a degree of effect, but problems still arise with regard to tightness which may cause wearer discomfort, rolling up of the leg areas leading to leakage of fluids, and wearer movement can create gapping in the groin and back regions.

GB 2 185 678 A discloses a disposable undergarment comprising an integral absorbent pad that can function as a light incontinence garment. The absorbent pad stretches upwards from the crotch region both in the back and the front region to a point higher than normal absorbent pads. The device is designed to substantially minimize the leakage of fluids in overnight use. The configuration may lead to wearer discomfort due to the built-in and high positioning of the absorbent pad.

U.S. Pat. No. 4,355,425 describes an improved panty and method of making the same that has both nonwoven porous fabric panels and nonwoven elastic members. The panty is characterized by elastication in all directions. Problems may arise regarding body contact and the positioning of the absorbent product. Furthermore, the panty is only designed from use by a woman or a child.

WO 92/00051 discloses an undergarment that includes a permanently stretched region within which the incontinence guard is placed and in which the material has a lower elasticity than tin the remaining regions of the undergarment. Such features enable the correct and ready positioning of the incontinence guard and improved wearer confidence. Nevertheless, the configuration leads to bunching in the back region and does not guarantee a high degree of body contact. Furthermore, when the incontinence guard is loaded, the undergarment is incapable of covering the incontinence guard effectively and leakage may occur.

WO 95/09594 relates to a light incontinence panty that is characterized by elastic devices, which extend from the front to the back part of the panty. The elastic devices may comprise elastic threads, ribbons or bands that are preferably mounted between two layers or sheets comprising the panty. The invention however does not disclose a garment that incorporates elasticity through an integral knitting technology. The panty may suffer from such drawbacks as wearer discomfort, sagging of the waistband and a poor fit.

U.S. Pat. No. 5,611,722, issued to Osborn on Mar. 18, 1997 describes a panty-type undergarment. The panty-type undergarment has a front panel, a rear panel, and a crotch portion. The undergarment further includes a substantially anchor-shaped support panel having a greater resistance to stretch than the rest of the undergarment which is integrally knit into the rear panel. The support panel is said to lift and separate the cheeks of a wearer's buttocks. The support panel includes a vertical strip and upwardly curving portions which extend toward and along a portion of the undergarment's leg openings. While such undergarments may lift and separate the cheeks of a wearer's buttocks, the undergarments fail to provide a lifting force that would improve bodily contact between a catamenial device and a wearer's pudendal region.

As is evident, the prior art garments reveal many shortcomings, namely poor body contact due to the movement of the wearer, poor fit, lack of wearer comfort, increased bulkiness leading to a clumsy and unappealing appearance, and leakage of fluids.

It has been discovered that the above drawbacks can be alleviated by a garment as disclosed in the present invention. The garment of the present invention enables both superior body contact and an excellent fit when the disposable absorbent article is both wet and dry. This leads to several benefits such as better positioning and containment of the absorbent article, improved acquisition properties, reduction in leakage and superior wearer confidence and comfort.

SUMMARY OF THE INVENTION

The present invention relates to garments/undergarments that have close, almost "second skin," body fit. In particular the garments of the present invention are particularly well suited for helping hold an absorbent article, such as an incontinence pad or incontinence device, in close bodily contact throughout a wide range of wearer motions.

The garment of the present invention comprises an elasticized waistband, a front panel having first and second sections, a rear panel having first and second sections, a crotch region disposed between and joining the front panel to the rear panel and a pair of elasticized leg openings.

The first section of the front panel has a greater resistance to stretching in the lateral direction than the second section of the front panel. The first section of the rear panel has a greater resistance to stretching in the lateral direction than the second section of the rear panel.

The crotch region is provided with a longitudinal stretch control member that is disposed along the longitudinal centerline of the undergarment. The longitudinal stretch control member limits the stretch of the crotch region in the longitudinal direction causing the crotch region to conform to a wearer's skin surface.

A front stretch control member is disposed in the front panel and extends from the longitudinal stretch control member to the waistband. A rear stretch control member is disposed in the rear panel and extends from the longitudinal stretch control member to the waistband.

While the garment of the present invention can be assembled from materials that may be known to the art as having the requisite mechanical properties, it is preferably knit. When the garment of the present invention is knit, the mechanical properties of the various components thereof can be provided by a combination of the knit pattern used for a particular component and the yarns that are used. In a particularly preferred embodiment of the present invention, the longitudinal stretch control member is integrally knit with the crotch region, the front stretch control member is integrally knit with the front panel, and the rear stretch control member is integrally knit with the rear panel.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which:

DETAILED DESCRIPTION OF THE INVENTION

The present invention relates to garments, more specifically to garments suitable for holding a disposable absorbent article in close contact with a wearer's body. A particularly preferred form of the present invention relates to a garment intended for use with incontinence devices, such as incontinence pads and diaper inserts, and the like, to hold such devices in close body contact to help reduce the leakage from such devices. It should be understood, however, that the present invention is also applicable for use not only with incontinence devices but also other absorbent articles such as feminine hygiene articles, such as sanitary napkins, panty liners, and the like.

As used herein, the term "incontinence device" refers to an absorbent article generally worn by incontinent persons about the lower torso for absorbing and containing bodily fluids, such as urine. Also as used herein, the term "disposable" refers to structures which are not intended to be laundered or otherwise restored or reused after use (i.e., they are intended to be discarded after a single use, and, perferably, to be recycled, composted or otherwise disposed of in an environmentally compatible manner). As used herein, the terms "fluid", "liquid" and the like are intended to be interchangeable and refer to materials that are in a liquid state when they are at a temperature of about 100° F.

General Description of the Garment

Figure 1:
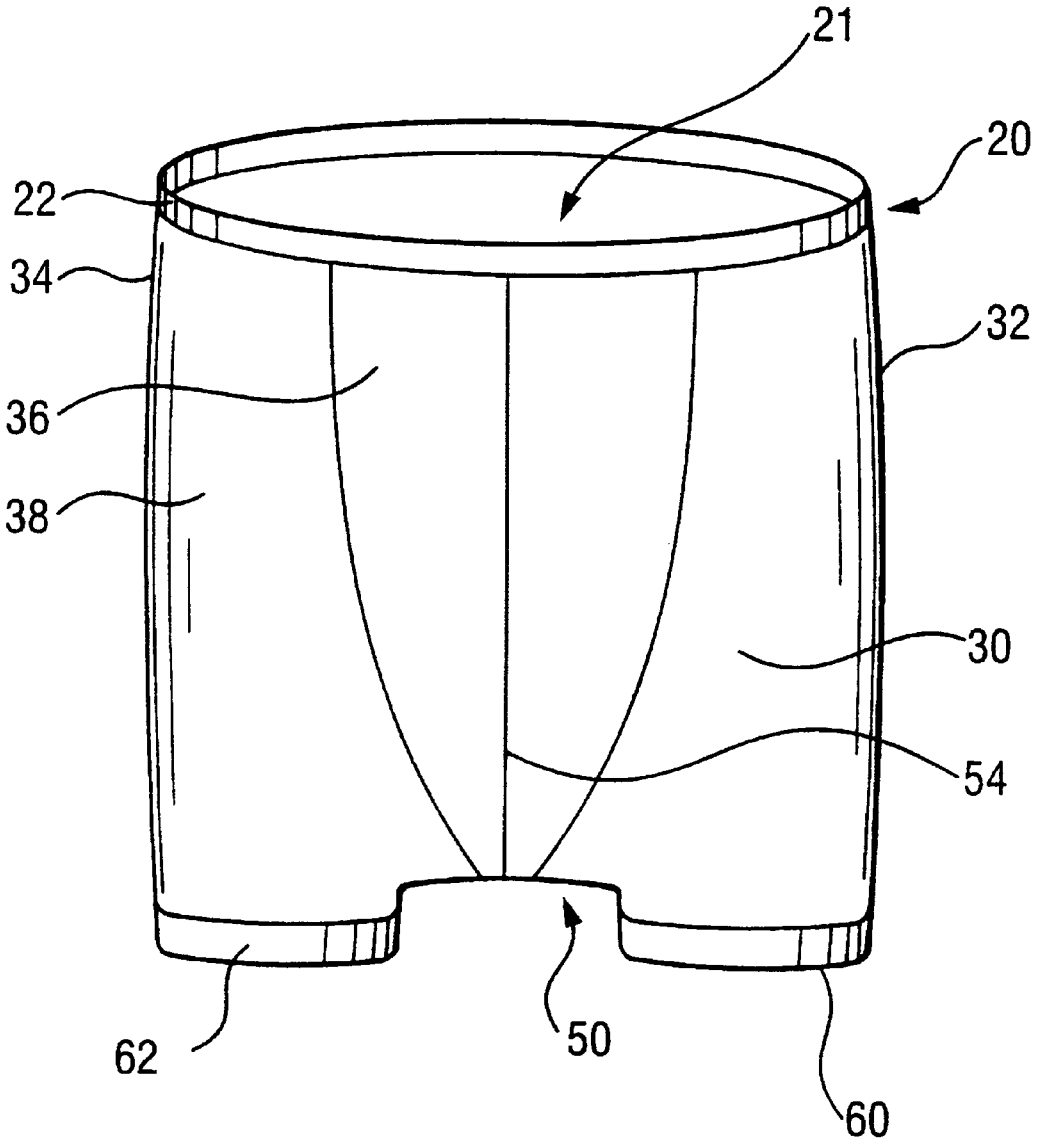
FIG. 1 is a front view of a preferred embodiment of the garment of the present invention.
Figure 2:
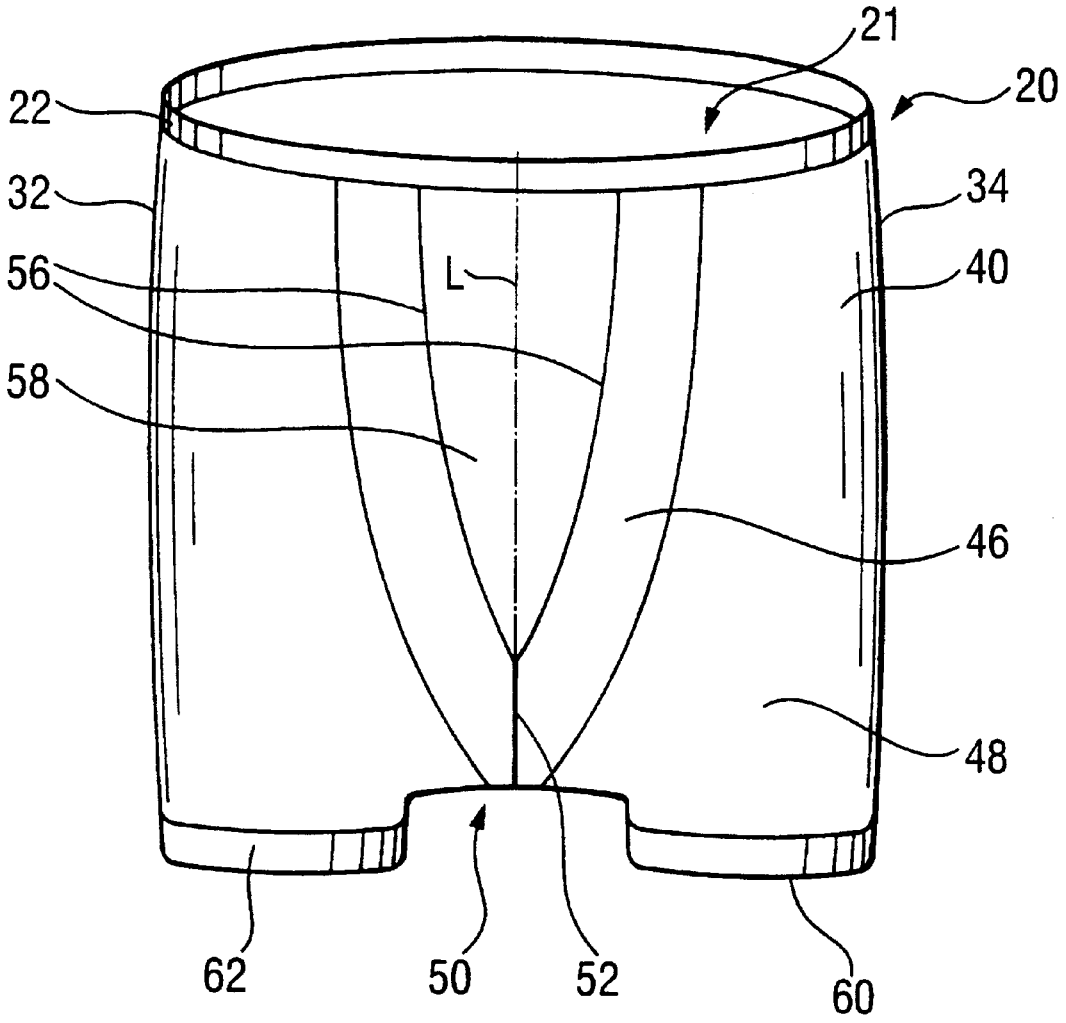
FIG. 2 is a rear view of the garment shown in FIG. 1.

While, as noted above, the present invention is suitable for use with a wide variety of absorbent articles, it will be described in terms of a garment 20 which may be used in conjunction with an incontinence device 100. FIGS. 1 and 2 show front and rear views of the incontinence garment 20 of the present invention. As is shown in FIGS. 1 and 2, the garment 20 of the present invention comprises a front panel 30 comprising first section 36 and second section 38, a rear panel 40 comprising first section 46 and second section 48, a crotch region 50, a pair of elasticized leg openings 60, and an elasticized waistband 22. The garment 20 is also provided with a waist opening 21 allowing entry into the garment 20. The garment 20 further comprises a longitudinal stretch control member 52 disposed along the longitudinal centerline in the crotch region 50, a front stretch control member 54 disposed in the front panel 30 and extending from the longitudinal stretch control member 52 to the waistband 22, and a rear stretch control member 56 disposed in the rear panel 40 and extending from the longitudinal stretch control member 52 to the waistband 22. Each of these elements will be described in greater detail in the following sections.

Figure 3:
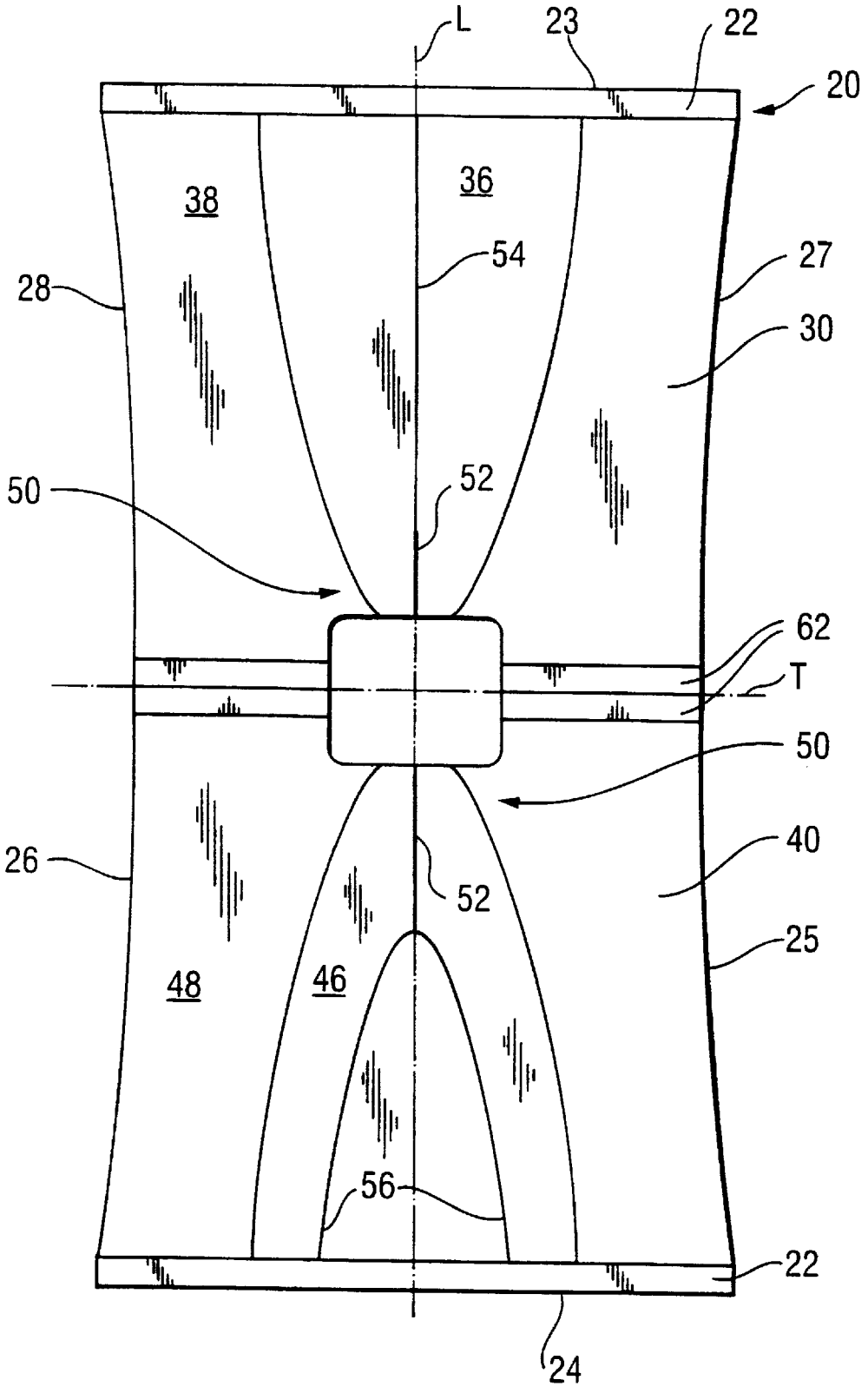
FIG. 3 is a plan view of the garment shown in FIG. 1 that has been opened at the sides, the elastic components being pulled flat.
Figure 4:
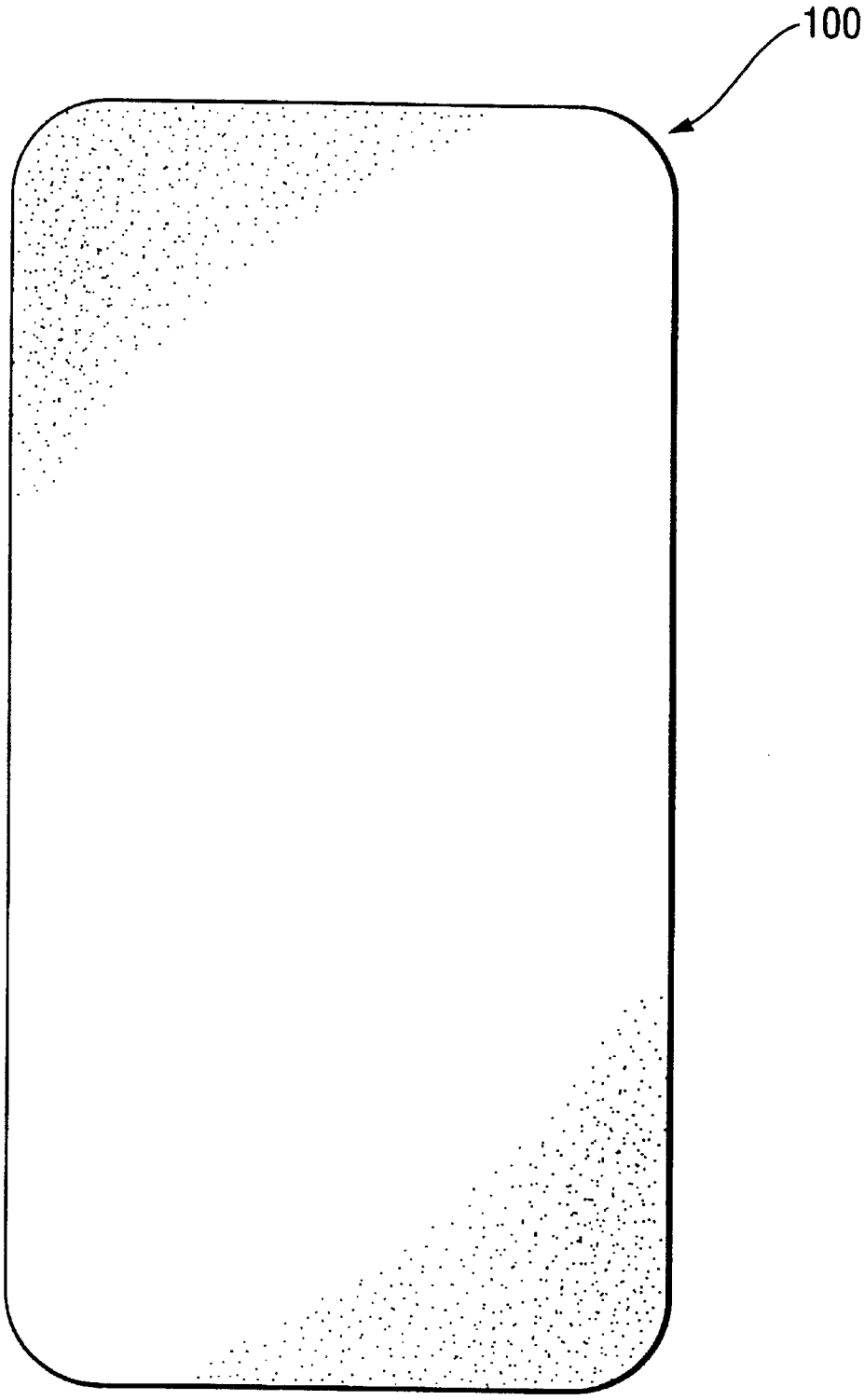
FIG. 4 is a plan view of an absorbent article suitable for use with the garment of the present invention.

FIG. 3 shows the garment 20 of the present invention in a full flat out position wherein each of the sides 32, 34 has been opened and elastic components have been pulled flat. FIG. 3 can also be considered to be a plan view of a blank for the garment 20 (see Forming the Garment below). As can be seen from FIG. 3, the garment 20 has a longitudinal centerline L and a transverse centerline T. As is also shown clearly in FIG. 3, the garment 20 of the present invention is symmetric about the longitudinal axis L and symmetric about the trasverse axis T. The garment 20 may also be symmetric about the longitudinal axis L and asymmetric about the transverse axis T.

The garment 20 can comprise woven, nonwoven or knit fabrics. Preferably the garment 20 comprises a knit fabric. A particularly preferred knitting means involves first knitting a seamless tubular blank approximately half the final width of the garment 20. The tubular blank may be knit to have an hour glass shape so as to provide for the leg openings 60 in the finished undergarment 20 or, alternatively, portions of the opened tube may be cut away to provide for such leg openings 60 (see Forming the Garment below).

The Elasticized Waistband

As noted above, the waist opening 21 allows entry into the garment 20 of the present invention. Preferably the waist opening 21 is provided with an elasticized waistband 22 such that the waist opening 21 conforms closely to a wearer's waist. The elasticized waistband 22 may be formed by providing an elastic member, such as a Lycra® or SPANDEX material, adjacent each distal end of the blank that is shown in FIG. 3, C-folding each distal end about itself to form end edges 23 and 24, and seaming the distal ends to the front panel 30 and the rear panel 40 to form the waist opening 21 and the elasticized waistband 22. Preferably, the elasticized waistband 22 comprises the same yarns as and is integrally knit with the front panel 30 and the rear panel 40. More preferably, the elasticized waistband 22 comprises a turned welt. A particularly preferred knitting pattern for the elasticized waistband 22 comprises a combination of plain knit stitches and float stitches wherein every fourth wale is provided with a positive float stitch.

The Front Panel

As can be seen in FIGS. 1 and 2, the front panel 30 is that portion of the garment 20 that cooperates with the rear panel 40 (discussed below) to encircle a wearer's waist and hips. As can be also seen in FIGS. 1 and 2, the front panel 30, the rear panel 40, and the crotch region 50 also cooperate to define the leg openings 60 (discussed in detail below). The front panel 30 comprises first section 36 and second section 38.

While alternate structures can be used, for example, the front panel 30 could be cut to an appropriate shape from a woven or nonwoven material and joined to the remaining portions of the garment 20. The front panel 30 of the present invention is preferably wholly plain knit more preferably jersey knit, from a combination of elastically extensible and non-elastically extensible yarns. As is clear to one of ordinary skill in the art, the elastic properties of the individual yarns and the particular knitting pattern can be used by a designer to define the mechanical properties of the front panel 30. In a particularly preferred embodiment of the present invention, the front panel 30 comprises alternating courses of wholly plain knit, preferably jersey knit, nylon and Lycra® or SPANDEX yarns as are available from Unifi, Inc. of Greensboro, N.C. In an alternative embodiment, the front panel 30 can be wholly plain knit, preferably jersey knit, using a Lycra® or SPANDEX yarn having suitable mechanical properties in all courses. As will be clear from the discussion of the mechanical properties of the front panel 30 below, one of skill in the art could define other knitting patterns using attentive yarns to provide such mechanical properties. As noted above, front panels 30 having such mechanical properties comprising woven or nonwoven materials are also envisioned.

In the preferred embodiment of the present invention shown in FIGS. 1 to 3, the first section 36 has a greater resistance to stretching in the lateral direction than the second section 38. Preferably, the first section 36 also has a greater resistance to stretching in the longitudinal direction than the second section 38. The greater elastic extensibility of the second section 38 enables the garment 20 to fit a variety of body shapes and sizes and provides good conformity to a wearer's body. The greater resistance to stretching of the first section 36, particularly in the lateral direction, provides a "z-direction" biasing force to the incontinence device 100 throughout the full range of wearer movement. Such a biasing force helps maintain the incontinence device 100 worn with the garment 20 in close bodily contact.

The Rear Panel

As mentioned above, the rear panel 40 is that portion of the garment 20 that cooperates with the front panel 30 to encircle a wearer's waist and hips. The rear panel 40 comprises first section 46 and second section 48.

While alternate structures can be used, for example, the rear panel 40 could be cut to an appropriate shape from a woven or nonwoven material and joined to the remaining portions of the garment 20. The rear panel 40 of the present invention is preferably wholly plain knit, more preferably jersey knit, from a combination of elastically extensible and non-elastically extensible yarns. As is clear to one of ordinary skill in the art, the elastic properties of the individual yarns and the particular knitting pattern can be used by a designer to define the mechanical properties of the rear panel 40. In a particularly preferred embodiment of the present invention, the rear panel 40 comprises alternating courses of wholly plain knit, preferably jersey knit, nylon and Lycra® or SPANDEX yarns as are available from Unifi, Inc. of Greensboro, N.C. In an alternative embodiment, the rear panel 40 can be wholly plain knit, preferably jersey knit, using a Lycra® or SPANDEX yarn having suitable mechanical properties in all courses. As will be clear from the discussion of the mechanical properties of the rear panel 40 below, one of skill in the art could define other knitting patterns using alternative yarns to provide such mechanical properties. As noted above, rear panels 40 having such mechanical properties comprising woven or nonwoven materials are also envisioned.

In the preferred embodiment of the present invention shown in FIGS. 1 to 3, the first section 46 has a greater resistance to stretching in the lateral direction than the second section 48. Preferably, the first section 46 also has a greater resistance to stretching in the longitudinal direction than the second section 48. The greater elastic extensibility of the second section 48 enables the garment 20 to fit a variety of body shapes and sizes and provides good conformity to a wearer's body. The greater resistance to stretching of the first section 46 provides a "z-direction" biasing force to the incontinence device 100 throughout the full range of wearer movement. Such a biasing force helps maintain the incontinence device 100 worn with the garment 20 in close bodily contact.

The Crotch Region

The crotch region 50 is positioned along the longitudinal centerline L of the undergarment 20 of the present invention between the front panel 30 and the rear panel 40. In the preferred embodiment of the present invention shown in FIGS. 1–3, the crotch region 50 cooperates with the front panel 30 and the rear panel 40 to define the leg openings 60. As is shown most clearly in FIG. 3, a longitudinal stretch control member is disposed along the longitudinal centerline L in the crotch region 50. The crotch region bridges the distance between the elasticized leg openings 60.

While alternate structures can be used, for example, the crotch region 50 could be cut to an appropriate shape from a woven or nonwoven material and joined to the remaining portions of the garment 20. The crotch region 50 of the present invention is preferably wholly plain knit, more preferably jersey knit, from a combination of elastically extensible and non-elastically extensible yarns. As is clear to one of ordinary skill in the art, the elastic properties of the individual yarns and the particular knitting pattern can be used by a designer to define the mechanical properties of the crotch region 50. In a particularly preferred embodiment of the present invention, the crotch region 50 comprises alternating courses of wholly plain knit, preferably jersey knit, nylon and Lycra® or SPANDEX yarns as are available from Unifi, Inc. of Greensboro, N.C. In an alternative embodiment, the crotch region 50 can be wholly plain knit, preferably jersey knit, using a Lycra® or SPANDEX yarn having suitable mechanical properties in all courses. As will be clear from the discussion of the mechanical properties of the crotch region 50 below, one of skill in the art could define other knitting patterns using alternative yarns to provide such mechanical properties. As noted above, crotch regions 50 having such mechanical properties comprising woven or nonwoven materials are also envisioned.

Preferably the crotch region 50 comprises a knit material having a lower longitudinal stretch modulus than the elasticized leg openings 60 or the longitudinal stretch control member 52. More preferably, as is shown in FIGS. 1–3, the crotch panel 50 is integrally knit with the front panel 30 and the rear panel 40 using a plain knit pattern and yarns having a high extensibility.

Longitudinal Stretch Control Member

As noted above the longitudinal stretch control member 52 serves to limit the stretch of the crotch region 50 along the longitudinal centerline L. In particular, the longitudinal stretch control member 52 limits the longitudinally oriented stretch of the crotch region 50 along the longitudinal centerline L. While not being bound by theory, the Applicants believe such longitudinal stretch limitation serves to transfer the "z-direction" biasing force from the rear panel 40 and from the front panel 30 to the crotch region 50. Such force transfer causes the crotch region 50 and any incontinence device 100 disposed thereon to be held closely against a wearer's body (particularly along the longitudinal centerline L of the garment 20) throughout a wide range of wearer movements.

The Applicants have found that the garment 20 of the present invention is particularly comfortable to wear, notwithstanding the close conformity of the present garment to and contact with a wearer's body, particularly in the crotch area as is discussed herein. Garments and/or undergarments of the prior art have attempted to achieve conformity to the crotch area by elasticized lifting members, such as cinches, or by a very tight fit overall. These undergarments are often described as being uncomfortable. One source of such discomfort, particularly for cinch-type undergarments, is pressure on a wearer's anus. The tissue surrounding the anus is particularly sensitive to pressure and forces applied to the anus can cause discomfort. Cinch-type undergarments, such as that described in U.S. Pat. No. 3,608,551, typically use an elastically extensible member to provide a lifting force to seal an absorbent article against a wearer's perineum. Such elastic members are usually joined to the undergarment at a location that is positioned above a wearer's anus when the undergarment is worn. As a result, there is not only the desirable lifting force to seal an absorbent article against the wearer's perineum but also an uncomfortable pressure on a wearer's anus. On the other hand, the garment 20 of the present invention distributes the "z-direction" biasing force discussed above so that bodily contact is maintained throughout a wide range of wearer motions without unacceptable pressure on a wearer's anus.

As shown most clearly in FIG. 3, the longitudinal stretch control member 52 is disposed along the longitudinal centerline L in the crotch region 50. The longitudinal stretch control member 52 can be either a separate element joined to the crotch region 50 or it can be integral to the crotch region 50. Preferably, the longitudinal stretch control member 52 is integral to the crotch region 50. In a particularly preferred embodiment of the present invention, the longitudinal stretch control member 52 and the crotch region 50 are integrally knit.

As noted above, the longitudinal stretch control member 52 serves to limit stretch, particularly longitudinally oriented stretch in the crotch region 50 along the longitudinal centerline L. To this end, the longitudinal stretch control member 52 can comprise any material having a greater stretch modulus than the crotch region 50. For example, the longitudinal stretch control member 52 could comprise a high modulus film material or even a single strand of yarn or monofilament having a relatively high modulus. For the preferred integrally knit longitudinal stretch control member 52, the longitudinal stretch control member could comprise the same yarns used for the crotch region wherein the yarns comprising the stretch control member 52 were knit in a pattern known to the art as being stretch limiting. For example, the longitudinal stretch control member 52 can comprise a knit pattern wherein alternating courses thereof are tucked. Alternatively, an elastic yarn can be floated in to provide the longitudinal stretch control member 52 with additional stretch resistance as is also known in the art.

Suitable yarns for the longitudinal stretch control member 52 are substantially the same yarns or combinations of yarns as have been found to be suitable for the crotch region 50.

The longitudinal stretch control member 52 has a greater resistance to stretching in the longitudinal direction than said first section 36 of said front panel 30. The longitudinal stretch control member 52 has a greater resistance to stretching in the longitudinal direction than said first section 46 of said rear panel 40.

The Front Stretch Control Member

The front stretch control member 54 cooperates with the longitudinal stretch control member 52 to provide a "z-direction" biasing force along the longitudinal centerline L of the garment 20 particularly in the crotch region 50. This force helps lift the crotch region 50, particularly the longitudinal stretch control 52 member that is disposed therein, so that any incontinence device 100 that may be disposed thereon is in close body contact. In particular, the Applicants believe that the front stretch control member 54 directs the forces provided by the longitudinal stretch control member 52 to the waistband 22 to help lift the crotch region 50 into close bodily contact.

As noted above, the front stretch control member 54 helps provide "z-direction" biasing force along the longitudinal centerline L. Therefore, the front stretch control member 54 is preferably disposed along the longitudinal centerline L in the front panel 30. More preferably, the front stretch control member 54 divides the first section 36 of the front panel 30 into two identical sections. The front stretch control member 54 can be joined to the front panel 30 along the longitudinal centerline L. Preferably, the front stretch control member 54 is integral to the front panel 30. In the particularly preferred embodiment shown in FIGS. 1–3, the front stretch control member 54 is integrally knit with the first section 36 of the front panel 30.

To facilitate the direction of forces, the front stretch control member 54 should have less stretch than the first and second sections 36, 38 of the front panel 30. To provide such lower stretch, the front stretch control member 54 may comprise a material having a higher stretch modulus than the front panel 30 or a knit material having a knit pattern as is known in the art to provide greater stretch resistance. Higher stretch modulus materials suitable for use as a front stretch control member 54 include high modulus film materials, such as a polyester film material or even a single strand of yarn or monofilament having a relatively high modulus (e. g. cotton, polyester or nylon). Preferably, the front stretch control member 54 comprises the same yarns as are suitable for the first and second sections 36, 38 of the front panel 30 and is integrally knit therewith using a knit pattern having less stretch than the first and second sections 36, 38. That is, the yarns discussed above with respect to the first and second sections 36, 38 of the front panel 30 are also suitable for the front stretch control member 54. A particularly preferred knitting pattern for the front stretch control member 54 uses stitches known in the art to provide reduced stretch. For example, a pattern of tuck stitches has been found to be suitable.

The Rear Stretch Control Member

The rear stretch control member 56 cooperates with the longitudinal stretch control member 52 to provide a "z-direction" biasing force. This force helps lift the crotch region 50, particularly the longitudinal stretch control 52 member that is disposed therein, so that any incontinence device 100 that may be disposed thereon is in close body contact. In particular, the Applicants believe that the rear stretch control member 56 directs the forces provided by the longitudinal stretch control member 52 to the waistband 22 to help lift the crotch region 50 into close bodily contact.

As noted above, the rear stretch control member 56 helps provide a "z-direction" biasing force. The rear stretch control member 56 preferably extends from the longitudinal stretch control member 52 along two lines spaced from the longitudinal centerline L in the rear panel 40. By spacing the rear stretch control member 56 from the longitudinal centerline L, the high forces of the rear stretch control member 56 are diverted away from the longitudinal centerline L. Applicants have found this to be particularly important as this allows the first section 46 of the rear panel 40 to be positioned over the anus. Since the first section 46 has a lower resistance to stretch in both the longitudinal and lateral directions than the rear stretch control member 56, the first section is able to expand under lower forces. This zone of lower force expansion creates a pocket 58 in the rear panel 40 which can expand to contain BM.

The rear stretch control member 56 can be joined to the rear panel 40. Preferably, the rear stretch control member 56 is integral to the rear panel 40. In the particularly preferred embodiment shown in FIGS. 1–3, the rear stretch control member 56 is integrally knit with the first section 46 of the rear panel 40.

To facilitate the direction of forces, the rear stretch control member 56 should have less stretch than the first and second sections 46, 48 of the rear panel 40. To provide such lower stretch, the rear stretch control member 56 may comprise a material having a higher stretch modulus than the rear panel 40 or a knit material having a knit pattern as is known in the art to provide greater stretch resistance. Higher stretch modulus materials suitable for use as a rear stretch control member 56 include high modulus film materials, such as a polyester film material or even a single strand of yarn or monofilament having a relatively high modulus (e. g. cotton, polyester or nylon). Preferably, the rear stretch control member 56 comprises the same yarns as are suitable for the first and second sections 46, 48 of the rear panel 40 and is integrally knit therewith using a knit pattern having less stretch than the first and second sections 46, 48. That is, the yarns discussed above with respect to the first and second sections 46, 48 of the rear panel 40 are also suitable for the rear stretch control member 56. A particularly preferred knitting pattern for the rear stretch control member 56 uses stitches known in the art to provide reduced stretch. For example, a pattern of tuck stitches has been found to be suitable.

Elasticized Leg Openings

As can be seen in FIGS. 1–3, the garment 20 of the present invention is also provided with a pair of elasticized leg openings 60. As noted above, the front panel 30, the rear panel 40, and the crotch region 50 cooperate to define the periphery of each leg opening 60. This periphery is provided with a leg elastic 62 for elasticization of the leg opening 60. The leg elastics 62 both provide a seal against leakage of bodily fluids about the periphery of each leg.

While the leg elastics 62 must provide a minimal contractive force help to seal the periphery of the leg opening 60 against leakage of bodily fluids, it is important that the contractive force not be so great as to cause discomfort to a wearer. Minimizing the stretch modulus over the range of expected elastic extensions during the wear cycle also minimizes the risk of wearer discomfort. That is, if the leg elastics are designed to provide a contractive force at a typical in use extension, that force should not substantially increase for greater extensions that may either be due to a different wearer leg circumference or due to wearer movement.

The leg elastics 62 can be joined to the front panel 30, the rear panel 40, and the crotch region 50 about the periphery of the leg opening 60 using means known to those of skill in the art. Specifically, the leg elastics 62 are joined to that portion of the side edges 25, 26, 27, 28 which will surround the leg openings 60 (i. e. form the periphery thereof). For example, the leg elastics 62 can be joined to the front panel 30, the rear panel 40, and the crotch region 50 using adhesive means or by mechanical means, such as stitching. For the preferred knit garment 20 of the present invention, the leg elastics 62 are preferably joined to the front panel 30, the rear panel 40, and the crotch panel 50 by stitching thereto.

Optional Features

When used as a system with an incontinence device 100, the garment 20 of the present invention can also comprise means for reliably securing the incontinence device 100 on the garment 20. For example, the incontinence device 100 could be provided with a first portion of a cohesive material and the crotch region 50 could be provided with a second portion of a cohesive material. As used herein, a "cohesive material" is one which preferentially adheres to itself and not to other materials. Such attachment systems are described in U.S. Pat. No. 5,415,650 which issued to Sigl on May 16, 1995, the disclosure of which is incorporated herein by reference.

Alternatively, a "hook and loop" fastening system can be used wherein the garment surface of the incontinence device 100 could be provided with a hook material. For example, a prong made according to U.S. Pat. No. 5,058,247, which issued to Thomas, et al. on Oct. 22, 1991, the disclosure of which is incorporated herein by reference, would be a satisfactory hook material. The crotch region 50 could be provided with a loop material as is known to the art or, preferably, the yarns and/or knitting pattern used for the crotch region 50 could be modified according to the art to provide loops for engaging a hook material.

The crotch region 50 can also optionally be provided with indicia to help a wearer optimally position an incontinence device 100 therein. For example, such indicia could comprise markings along the longitudinal centerline L that would allow a wearer to reliably position a incontinence device 100 each time a new device is disposed on the body contacting (i.e. inner) surface of the crotch region 50. In addition, the front panel 30 and the rear panel 40 can also optionally be provided with indicia to help a wearer optimally position an incontinence device 100 therein.

Forming the Undergarment

A blank for the garment 20 is first knit in a tubular form using means known to the art. In particular, front panel 30, the rear panel 40, the crotch region 50 are integrally knit. The first section 36 of the front panel 30 is provided with a front stretch control member 54 by having such a strip integrally knit therein. The first section 46 of the rear panel 40 is provided with a rear stretch control member 56 by having such a strip integrally knit therein. Similarly, the crotch region 50 is provided with an integrally knit longitudinal stretch control member 52. The appropriate knit patterns as described above are used.

The tubular blank is then slit walewise and opened. Excess material that would otherwise fill the leg openings 60 is removed to form a flat blank for the garment 20 having a shape similar to the plan view of the garment 20 that is shown in FIG. 3. As is further shown in FIG. 3, the blank for the garment has a front end edge 23, a rear end edge 24, front side edges 25, 26, and rear side edges 27, 28.

The leg elastics 62 are joined to the garment 20 about the periphery of the leg openings 60 as discussed above. The blank for the garment 20 is then folded about the transverse centerline T and opposing portions of the side edges that lie between the leg opening 60 and the end edges 23, 24 are joined to form side seams 32, 34 completing the assembly of garment 20 (That is, the portion of side edge 25 that lies between the end of the leg elastic 62 in front panel 30 and the end edge 24 is joined to the portion of side edge 27 that lies between the end of the leg elastic 62 that lies in the rear panel 40 and the end edge 23 to form seam 32. Side edge 26 is joined to side edge 28 in a similar manner to form seam 34).

Alternatively, portions of the tubular knit blank can be cut out to provide the leg openings 60. For example, a tubular blank can be flattened, such that, the interior faces thereof contact each other and a pair longitudinally oriented side edges are formed. Leg opening precursors can then be formed by cutting matching portions having a semi-circular, semi-elliptical, or other desired shape from transversely opposite side edges at regular intervals along the flattened blank. Garment blanks are then formed by transversely cutting the flattened tubular blank in a predetermined repeat pattern wherein a first transverse cut is made across the material that was not removed when the leg opening precursors were formed to create a crotch portion precursor and a second transverse cut is made across the full width of the flattened tubular blank forming the waist opening 21. The leg elastics 62 are disposed about the periphery of each leg opening 60 and joined thereto. The two ends formed by the first transverse cut are joined by a single transverse seam to complete the crotch region 50. The garment 20 is then finished by disposing the elasticized waistband 22 about the periphery of the waist opening 21 and joining the elasticized waistband 22 thereto.

Alternative Embodiments

Figure 5:
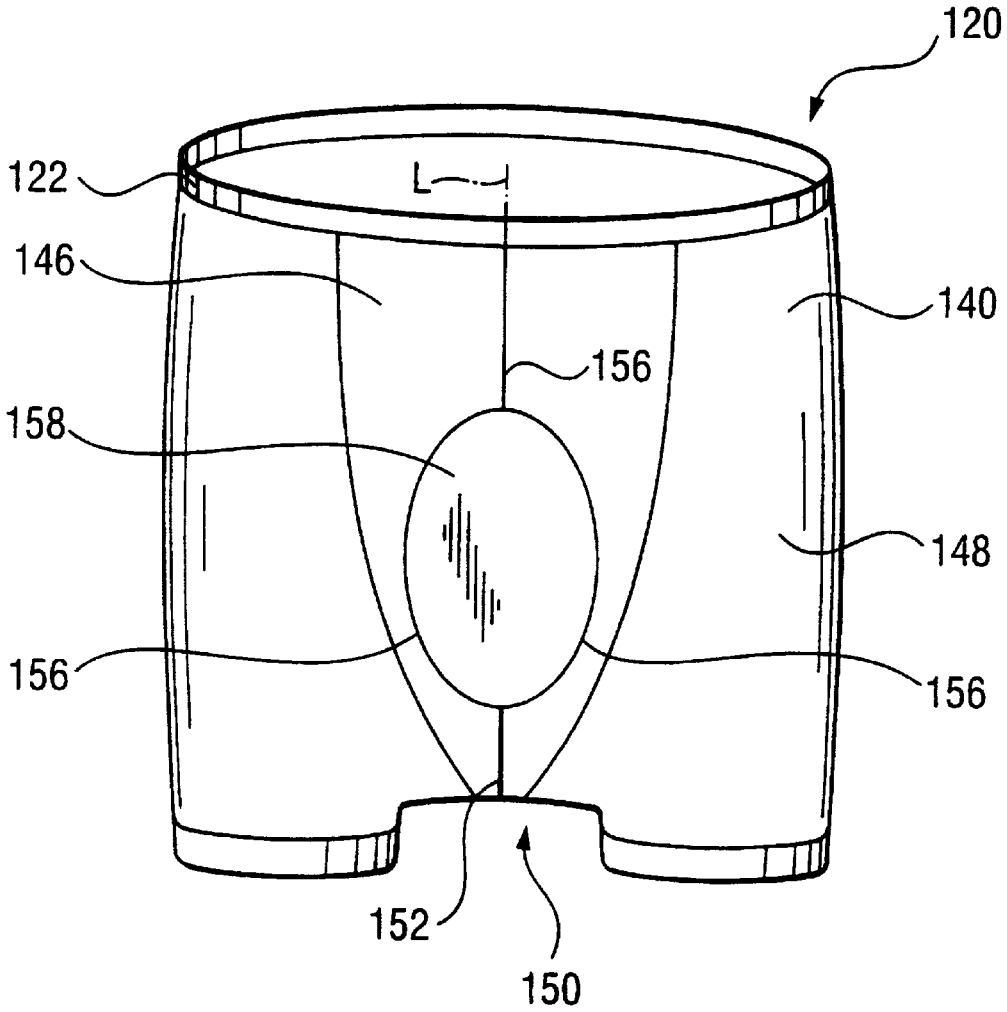
FIG. 5 is a rear view of an alternative embodiment of a garment of the present invention.

Referring now to FIG. 5 there is shown a rear view of an alternative embodiment of a garment 120 of the present invention. Garment 120 is identical to garment 20 except for the configuration of the rear stretch control member 156.

The rear stretch control member 156 cooperates with the longitudinal stretch control member 152 to provide a "z-direction" biasing force. This force helps lift the crotch region 150, particularly the longitudinal stretch control 152 member that is disposed therein, so that any incontinence device 100 that may be disposed thereon is in close body contact In particular, the Applicants believe that the rear stretch control member 156 directs the forces provided by the longitudinal stretch control member 152 to the waistband 122 to help lift the crotch region 150 into close bodily contact.

As noted above, the rear stretch control member 156 helps provide a "z-direction" biasing force. The rear stretch control member 156 preferably extends from the longitudinal stretch control member 152 along two arcuate lines spaced from the longitudinal centerline L along a portion of their length and then converge to form a single line along the longitudinal centerline L prior to reaching the waistband 122. By spacing the rear stretch control member 156 from the longitudinal centerline L at least along a portion of its length, the high forces of the rear stretch control member 156 are diverted away from the longitudinal centerline L creating a pocket 158. Applicants have found this to be particularly important as the design of the garment 120 positions the pocket 158 over the anus. Since the pocket 158 has a lower resistance to stretch in both the longitudinal and lateral directions than the rear stretch control member 156, the pocket 158 is able to expand under lower forces. This zone of lower force expansion creates a pocket 158 in the rear panel 140 which can expand to contain BM.

The rear stretch control member 156 can be joined to the rear panel 140. Preferably, the rear stretch control member 156 is integral to the rear panel 140. In the particularly preferred embodiment shown in FIG. 5, the rear stretch control member 156 is integrally knit with the first section 146 of the rear panel 140.

To facilitate the direction of forces, the rear stretch control member 156 should have less stretch than the first and second sections 146, 148 of the rear panel 140. To provide such lower stretch, the rear stretch control member 156 may comprise a material having a higher stretch modulus than the rear panel 140 or a knit material having a knit pattern as is known in the art to provide greater stretch resistance. Higher stretch modulus materials suitable for use as a rear stretch control member 156 include high modulus film materials, such as a polyester film material or even a single strand of yarn or monofilament having a relatively high modulus (e. g. cotton, polyester or nylon). Preferably, the rear stretch control member 156 comprises the same yarns as are suitable for the first and second sections 146, 148 of the rear panel 140 and is integrally knit therewith using a knit pattern having less stretch than the first and second sections 146, 148. That is, the yarns discussed above with respect to the first and second sections 146, 148 of the rear panel 140 are also suitable for the rear stretch control member 156. A particularly preferred knitting pattern for the rear stretch control member 56 uses stitches known in the art to provide reduced stretch. For example, a pattern of tuck stitches has been found to be suitable.

Figure 7:
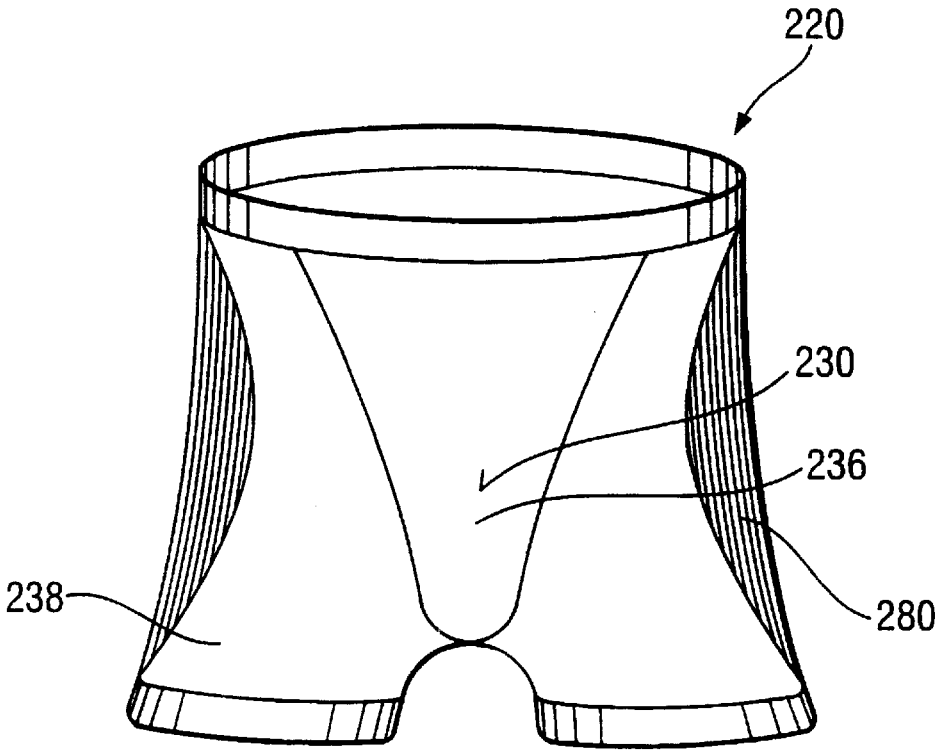
FIG. 7 is a front view of the garment shown in FIG. 6.
Figure 6:
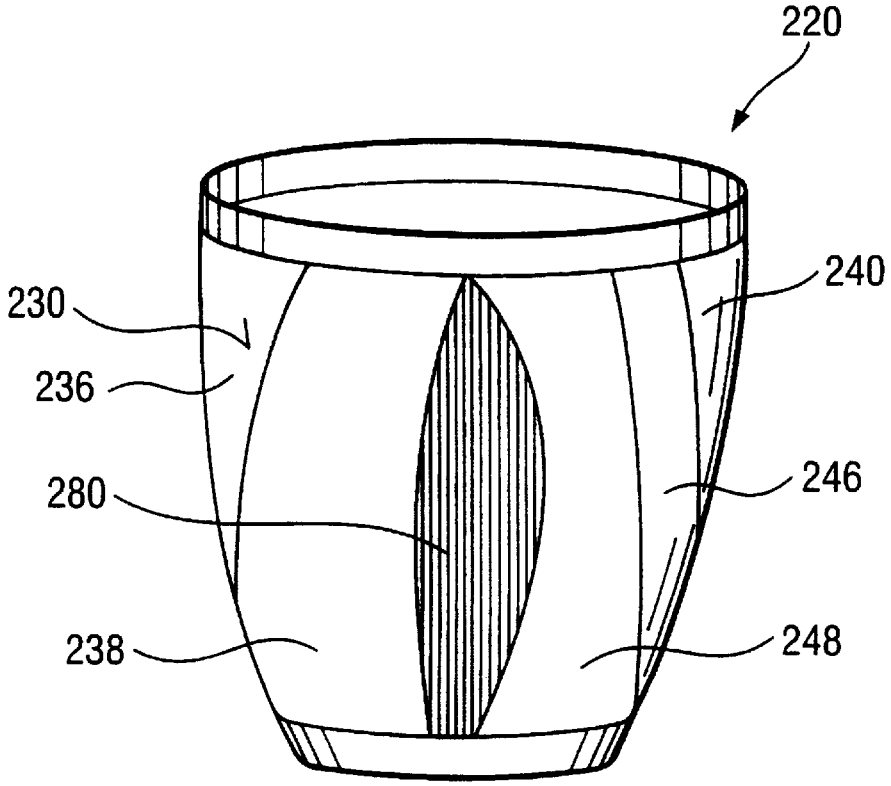
FIG. 6 is a side view of an alternative embodiment of a garment of the present invention.

Referring now to FIGS. 6 and 7 there is shown an alternative embodiment of a garment 220 of the present invention. Garment 220 is identical to garment 20 except for the addition of the side panels 280.

As can be seen in FIGS. 6 and 7, the side panel 280 is that portion of the garment 220 that cooperates with the front panel 230 and the rear panel 240 to encircle a wearer's waist and hips. More specifically, the side panel 280 is that portion of the garment 220 that joins the second section 238 of the front panel 230 with the second section 248 of the rear panel 240.

While alternate structures can be used, for example, the side panel 280 could be cut to an appropriate shape from a woven or nonwoven material and joined to the remaining portions of the garment. The side panel 280 is preferably wholly plain knit, more preferably jersey knit, from a combination of elastically extensible and non-elastically extensible yarns. As is clear to one of ordinary skill in the art, the elastic properties of the individual yarns and the particular knitting pattern can be used by a designer to define the mechanical properties of the side panel 280. In a particularly preferred embodiment of the present invention, the side panel 280 comprises alternating courses of wholly plain knit, preferably jersey knit, nylon and Lycra® or SPANDEX yarns as are available from Unifi, Inc. of Greensboro, N.C. In an alternative embodiment, the side panel 280 can be wholly plain knit, preferably jersey knit, using a Lycra® or SPANDEX yarn having suitable mechanical properties in all courses. As will be clear from the discussion of the mechanical properties of the side panel 280 below, one of skill in the art could define other knitting patterns using alternative yarns to provide such mechanical properties. As noted above, side panels 280 having such mechanical properties comprising woven or nonwoven materials are also envisioned.

In the embodiment shown in FIGS. 6 and 7, the side panel 280 has a greater resistance to stretching in the lateral direction than the second section 238 of the front panel 230 and the second section 248 of the rear panel 240. Preferably, the side panel 280 has a greater resistance to stretching in the longitudinal direction than the second section 238 of the front panel 230 and the second section 248 of the rear panel 240.

In the embodiment shown, the first section 236 of the front panel 230 has a greater resistance to stretching in the lateral direction than the side panel 280. The first section 246 of the rear panel 240 has a greater resistance to stretching in the lateral direction than the side panel 280. The first section 236 of the front panel 230 has a greater resistance to stretching in the longitudinal direction than the side panel 280. The first section 246 of the rear panel 240 has a greater resistance to stretching in the longitudinal direction that the side panel 280.

During use it is preferred that the second sections 238 and 248 stretch first as they provide the least resistance to stretch. If the wearing forces are increased, the side panels 280 should stretch next with the last portions of the pant to expand being the first sections 236 and 246. This is preferred as first sections 236 and 246 are intended to maintain the incontinence pad in place while the other sections, second sections 238 and 248 and side panels 280, are intended to provide close body fit.

Referring now to FIG. 2, there is shown a preferred embodiment of a rear stretch control member 56 which extends from the longitudinal stretch control member 52 along two lines spaced from the longitudinal centerline L in the rear panel 40. A similar construction of the front stretch control member 54 to that of the rear stretch control member 56 shown in FIG. 2, i.e., having the front stretch control member 54 extend from the longitudinal stretch control member 52 along two lines spaced from the longitudinal centerline L, may be advantageous for the male user to provide a lower force region in the garment adjacent the male genitalia. Similarly, the front stretch control member may be constructed similar to the rear stretch control member 156 shown in FIG. 5 to provide a pocket for the male genitalia which has a lower resistance to stretch than the stretch control member.

Figure 8:
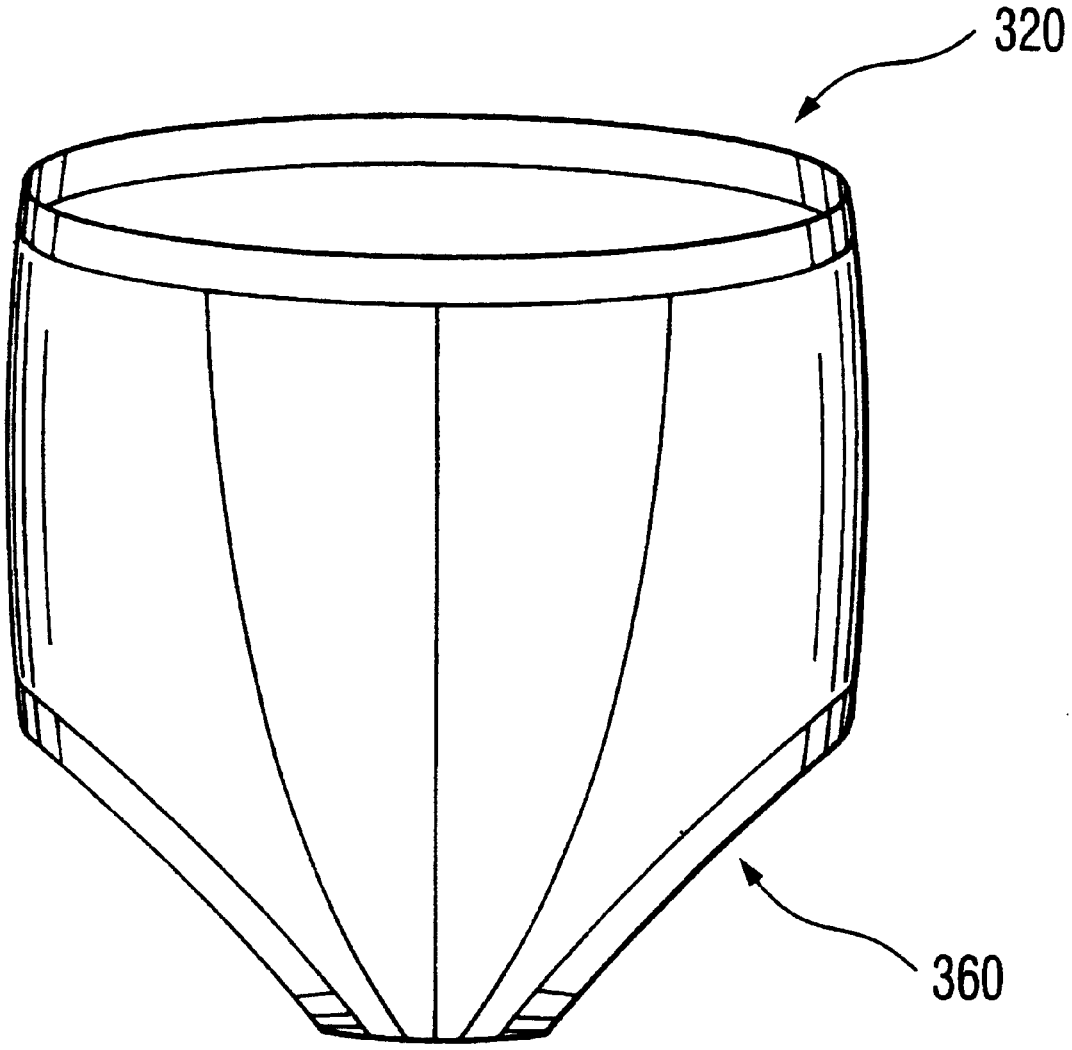
FIG. 8 is a front view of an alternative embodiment of a garment of the present invention.

Referring now to FIG. 8 there is shown an alternative embodiment of a garment 320 of the present invention. Garment 320 is identical to garment 20 except for the configuration of the elasticized leg openings 360. As can be seen in FIG. 8 the elasticized leg openings 360 are cut higher compared to elasticized leg openings 60 shown in FIG. 1. The higher cut of elasticized leg openings 360 provides a bigger opening that leg openings 60. In addition, garment 320 uses less overall material than garment 20.

TEST METHODS

Stretch Modulus and Elastic Contractions

Intent

This method is intended to quantify a force comparable to the force exerted on a wearer's body by extensible materials that may be used in an undergarment over an extension range similar to that seen in the wear cycle of an undergarment.

Method

The method described in INDA (Association of Nonwoven Fabric Industry) Standard Test 110. 1-92 is suitable. The following set up conditions are used:

Gage Length: 2 inches (5.08 centimeters)

Crosshead Speed: 10 inches/minute (25.4 centimeters/minute)

Tensile Testing Machine and Load Cell: Appropriate for expected force range, a Model 5564, available from Instron Corporation, Canton, Mass. is suitable Sample Width: 1 inch (2.54 centimeters) For samples less than 1 inch (2.54 wide, measure the sample width and adjust the measured force by the ratio of 1 inch (2.54 centimeters) to the measured width.

Sample Direction: Longitudinal stretch modulus samples are cut so the sample width is perpendicular to the longitudinal direction. Lateral stretch modulus samples are cut so the sample width is perpendicular to the lateral direction.

Sample Size: At least three samples per material tested

Calculations $Force_0$: Force at start of data collection (grams/inch or grams/cm) Is there a prestretch before starting to take data $Force_{25}$: Force at 25% elongation (grams/inch or grams/cm)

Elastic Contractions=$Force_{25}$

Stretch Modulus=$(Force_{25}-Force_0)/0.25$

Report the mean and standard deviation for elastic contractions (leg elastics only) and for stretch modulus The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A garment for holding a disposable absorbent article in close bodily contact, said garment having a longitudinal centerline defining a longitudinal direction and a lateral centerline defining a lateral direction, said garment comprising:

an elasticized waistband;

a front panel having first and second sections, said first section having a greater resistance to stretching in the lateral direction than that of said second section;

a rear panel having first and second sections, said first section having a greater resistance to stretching in the lateral direction than that of said second section;

a crotch region disposed between and joining said front panel to said rear panel;

a pair of elasticized leg openings;

a longitudinal stretch control member disposed along said longitudinal centerline in said crotch region, said longitudinal stretch control member serving to limit the extent of longitudinally oriented stretch of said crotch region along the longitudinal centerline;

a front stretch control member disposed in said front panel and extending from said longitudinal stretch control member to said waistband to direct the forces from said longitudinal stretch control member to said waistband; and a rear stretch control member disposed in said rear panel and extending from said longitudinal stretch control member to said waistband to direct the forces from said longitudinal stretch control member to said waistband.

2. A garment according to claim 1 wherein said first section of said front panel has a greater resistance to stretching in the longitudinal direction than that of said second section of said front panel.

3. A garment according to claim 1 wherein said first section of said rear panel has a greater resistance to stretching in the longitudinal direction then that of said second section of said rear panel.

4. A garment according to claim 1 wherein said longitudinal stretch control member has a greater resistance to stretching in the longitudinal direction than that of said first section of said front panel.

5. A garment according to claim 1 wherein said longitudinal stretch control member has a greater resistance to stretching in the longitudinal direction than that of said first section of said rear panel.

6. A garment according to claim 1 wherein said front stretch control member extends along said longitudinal centerline.

7. A garment according to claim 1 wherein said rear stretch control member extends to said waistband along two lines spaced from said longitudinal centerline.

8. A garment according to claim 1 wherein said rear stretch control member extend to said waistband along two lines to form a pocket in said rear panel.

9. A garment according to claim 1 wherein said first and second sections of said front panel have a longitudinal stretch modulus, said longitudinal stretch modulus of said first section being greater than said longitudinal stretch modulus of said second section.

10. A garment according to claim 1 wherein said first and second sections of said rear panel have a longitudinal stretch modulus, said longitudinal stretch modulus of said first section being greater than said longitudinal stretch modulus of said second section.

11. A garment according to claim 1 wherein said first and second sections of said front panel have a lateral stretch modulus, said lateral stretch modulus of said first section being greater than said lateral stretch modulus of said second section.

12. A garment according to claim 1 wherein said first and second sections of said rear panel have a lateral stretch modulus, said lateral stretch modulus of said first section being greater than said lateral stretch modulus of said second section.

13. A garment according to claim 1 wherein said garment comprises a knit material.

14. A garment according to claim 13 wherein said longitudinal stretch control member comprises a knitting pattern having less longitudinal stretch than a wholly knit pattern.

15. A garment according to claim 14 wherein said longitudinal stretch control member comprises a pattern of tuck stitches.

16. A garment according to claim 13 wherein said front and rear stretch control members comprise a knitting pattern having less longitudinal stretch than a wholly knit pattern.

17. A garment according to claim 16 wherein said front and rear stretch control members comprise a pattern of tuck stitches.

18. A garment according to claim 1 wherein said longitudinal stretch control member is integrally knit with said crotch region, said front stretch control member is integrally knit with said first section of said front panel, and said rear stretch control member is integrally knit with said first section of said rear panel.

19. A garment according to claim 1 further comprising a side panel joining said first panel to said rear panel.

20. A garment according to claim 19 wherein said side panel has a greater resistance to stretching in the lateral direction than that of said second section of said front panel.

21. A garment according to claim 19 wherein said side panel has a greater resistance to stretching in the lateral direction than that of said second section of said rear panel.

22. A garment according to claim 19 wherein said first section of said front panel has a greater resistance to stretching in the lateral direction than that of said side panel.

23. A garment according to claim 19 wherein said first section of said rear panel has a greater resistance to stretching in the lateral direction than that of said side panel.

* * * * *